United States Patent [19]

Cournoyer

[11] Patent Number: 4,516,676

[45] Date of Patent: May 14, 1985

[54] HOUSEHOLD CLEANING KIT

[76] Inventor: Roger J. A. Cournoyer, 17200 Libby Rd., Maple Heights, Ohio 44137

[21] Appl. No.: 566,106

[22] Filed: Dec. 27, 1983

[51] Int. Cl.[3] ..... B65D 83/14

[52] U.S. Cl. ..... 206/226; 206/225; 206/229; 225/106

[58] Field of Search ..... 206/225, 226, 229; 225/106

[56] References Cited

U.S. PATENT DOCUMENTS

| | | | |
|---|---|---|---|
| 603,316 | 5/1898 | Bush | 206/226 |
| 1,255,772 | 2/1918 | Miller | 206/226 |
| 1,476,604 | 12/1923 | Foreman | 206/225 |
| 1,615,319 | 1/1927 | Wynn | 206/229 |
| 1,769,321 | 7/1930 | Toth . | |
| 1,942,953 | 1/1934 | Bennett | 206/229 |
| 2,331,675 | 10/1943 | Frost | 206/226 |
| 2,864,118 | 12/1958 | Adams et al. | 206/226 |
| 3,052,910 | 9/1962 | Kushner . | |
| 3,722,021 | 3/1973 | Brainerd et al. | 206/229 |
| 3,754,831 | 8/1973 | Hutter . | |
| 3,881,628 | 5/1975 | Brainerd et al. | 206/229 |
| 4,035,090 | 7/1977 | Bavaveas | 401/139 |

FOREIGN PATENT DOCUMENTS

| | | | |
|---|---|---|---|
| 1060705 | 11/1953 | France | 206/235 |

*Primary Examiner*—William T. Dixson, Jr.
*Assistant Examiner*—Brenda J. Ehrhardt
*Attorney, Agent, or Firm*—William H. Wright

[57] ABSTRACT

This invention relates to combined cleaning devices in general, and more specifically to a window cleaning kit that contains a liquid applicator, a paper towel dispenser, and an absorbent scrubbing element in a single self contained unit.

1 Claim, 5 Drawing Figures

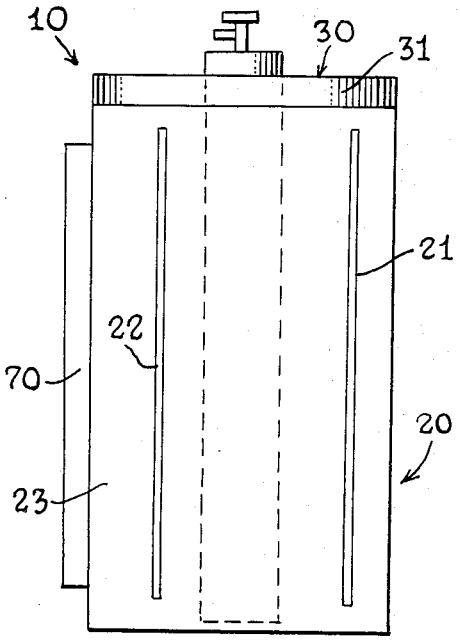
FIG. 1.
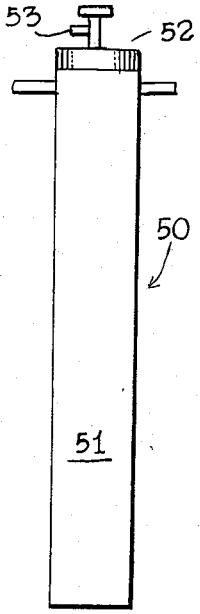
FIG. 2.
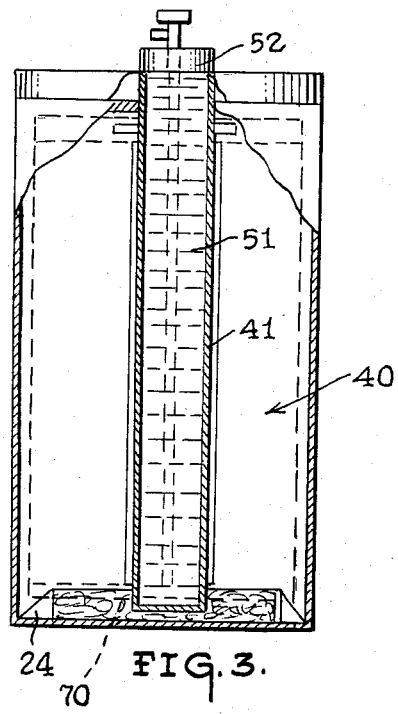
FIG. 3.
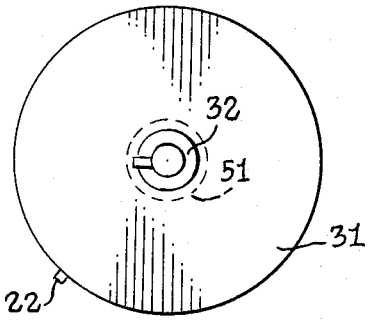
FIG. 4.
FIG. 5.
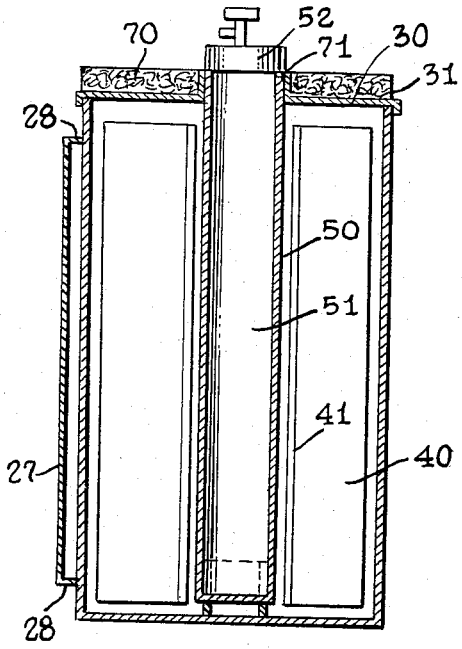

HOUSEHOLD CLEANING KIT

BACKGROUND OF THE INVENTION

The prior art is replete with dual function devices contained in a single unit as can be seen by reference to U.S. pat. Nos. 4,035,090; 3,052,910; 3,754,831 and 1,769,321. However, as anyone that has washed windows can attest to, there has been a long felt need for a single implement that would contain all of the necessary elements employed in that task.

Most people when washing windows carry a roll of paper towels, a window spray applicator, and a sponge for stubborn stains. While the sponge and spray applicator are relatively stable articles and will normally remain in the same location that they were placed; a roll of paper towels is a notoriously unstable article, that also exhibits an almost uncanny ability to roll away and/or unravel at the most inopportune times.

Given the fact that we are discussing three seperate items, and one of those items causes seperate problems unique onto itself; it should be readily apparent that a totally new device was required to solve these problems. After long consideration and study, the combined device that forms the basis of the present invention was developed to provide that solution in a simple and efficient manner.

SUMMARY OF THE INVENTION

An object of the present invention is to provide a self contained-unit that will simplify the task of cleaning surfaces such as windows or the like.

Another object of the present invention is to provide a device that contains all of the elements normally employed in household cleaning chores.

Still another object of the present invention is to provide a device housing, wherein well recognized cleaning elements cooperate with one another in a totally new and unique manner.

A further object of the present invention is to provide a device that not only stores cleaning implements in and on a single housing, but also allows the implements to be employed in conjunction with one another during the cleaning process.

Yet another object of the present invention is to provide a device that satisfies a long felt need, and accomplishes that task in a simple and efficient manner.

These and other objects, advantages, and novel features of the invention will become apparent, from the detailed description that follows, when considered in conjunction with the accompanying drawings.

BRIEF DESCRIPTION OF THE DRAWINGS

FIG. 1, is a side elevation of one form of the preferred embodiment.

FIG. 2, is a detail view of one form of the fluid spray applicator and cap member.

FIG. 3, is a cross sectional view of another form of the preferred embodiment.

FIG. 4, is a top plan view of the embodiment illustrated in FIG. 1.

FIG. 5, is a cross sectional view of another form of the preferred embodiment.

DETAILED DESCRIPTION OF THE PREFERRED EMBODIMENT

As can be seen by reference to FIG. 1, the cleaning kit is designated generally as 10, and comprises a container body 20, and a cover member 30. The container body 20 is generally cylindrical in configuration, and dimensioned to receive a standard sized roll 40 of paper towels or the like. In addition the container body 20 is provided with an elongated vertically disposed dispensing slot 21, that allows the paper to be withdrawn from the interior of the container 20, in a well recognized manner. The container 20 may also be provided, as shown in the drawings, with an elongated vertically disposed raised strip 22, which is spaced from the dispensing slot 21, and serves as a severing edge for the dispensed paper product.

As can best be seen by reference to FIGS. 2 and 3 the liquid spray applicator 50, that has been developed for use in conjunction with the container 20 and cover member 30, comprises an elongated tubular receptacle 51, that is dimensioned to fit within the core 41 of the roll of paper 40. The applicator receptacle 51 is further adapted to be operatively connected to, and sealed by, a spray actuator 52, in any one of a number of well recognized manners. The spray actuator 52 also comprises a spray nozzle 53 that is mounted for reciprocation with respect to the receptacle 51, again in a well recognized manner.

In the embodiment illustrated in FIG. 1, the spray applicator 50 is constructed as a separate unit, and is dimensioned to frictionally engage the walls of the core 41 of the paper roll, to resist relative rotation between the roll of paper 40 and the applicator 50. In this embodiment, the cover member 30 comprises a lid element 31, that is adapted to engage the periphery of the container opening, and which is further provided with a central aperture 32 that allows the applicator to rotate with respect to the container body 20, yet will engage a portion of the fluid applicator 50 to prevent the applicator from falling out, when the container is tipped over or inverted. In this version, both the roll of paper 40 and the applicator 50 rotate relative to the container as the paper is withdrawn through the dispensing slot 21.

In the embodiment illustrated in FIG. 5, the cover member 30 is formed integrally with a portion of the fluid applicator 50, however, the fluid receptacle 51 is dimensioned to allow the roll of paper to rotate freely with respect thereto, as the paper is being withdrawn from the container. Since the cover member and the applicator are joined together in this version, there is again no possiblity for the applicator to become disengaged while the cover member is in place.

The last structural feature that comprises this invention, consists of a sponge or scouring member 70 that may be releasably or permanently attached to a portion of the device. FIG. 1 shows the sponge 70 permanently attached to the exterior wall 23 of the container body. FIG. 3 shows the sponge releasably secured in recess 24 formed in the bottom of the container body; and in FIG. 5 the sponge 70 is releasably secured to the fluid applicator 50, by means of a central aperture 71 formed in the sponge, and dimensioned to frictionally engage a portion of the applicator 50 that projects above the cover member.

FIG. 5 shows two additional features for aiding the effectiveness of the invention. To help hold the paper towel 40 in place, a circular raised embossment 26 is formed at the base of the container body 20, centrally thereof so as to rest within and frictionally engage the paper towel core 41. Further, an elongated U-shaped element 27 is secured by its legs 28 to a side of the container body 20 such that paper may slide therethrough and be held in place after the paper has been cut. The element 27 is placed parallel the severing strip 22, between it and the dispensing slot.

It should be appreciated by now, that a device built in accordance with the above teachings would produce a self contained cleaning kit that would include all of the items normally required for household cleaning. In addition, the problems associated with rolls of paper towels would also be eliminated, since the container body, and the presence of the applicator receptacle axially disposed within the roll of paper, insures that the dispensing of the paper will progress smoothly.

Having thereby described the subject matter of this invention, it should be obvious that many modifications, substitutions, and alterations are possible in light of the above teachings. It is, therefore, to be understood that the invention as taught and described is only to be limited to the extent of the breadth and scope of the appended claims.

What I claim is:

1. A household cleaning kit for use with a roll of paper wound upon a core, comprising:

a fluid spray applicator having an elongated tubular receptacle and activator and nozzle means fixed to said receptacle;

a cylindrical container body forming an interior space, and having an elongated dispenser slot formed through said body and communicating with said interior space, an elongated exterior severing strip fixed to said body and disposed parallel to, and spaced apart from, said slot, a U-shaped member fixed to said body between, and parallel to, said slot and said strip, and an open end communicating with said interior space, said applicator being received by said interior space to form a generally annular space, said applicator being aligned with said strip, slot and U-shaped member, said activator and nozzle means projecting through said open end;

cover means for sealing said container body attached over said open end aperture means being formed therethrough for allowing said activator and nozzle means to project beyond said cover means while retaining said applicator in said container body, said applicator being rotatable with respect to said cover means, aperture means and container body;

a sponge having a gripping aperture for receiving said activator and nozzle means, said sponge being secured to said activator and nozzle means but rotatable with respect thereto and removable therefrom; and the roll being received in said generally annular space, said tubular receptacle frictionally engaging the core whereby the roll and said tubular receptacle rotate together with respect to said container body, the paper being extendable through said slot and said U-shaped member and over said strip upon such rotation.

* * * * *